United States Patent [19]

Cusano

[11] 4,381,474

[45] Apr. 26, 1983

[54] SOLID STATE STORAGE DEVICES AND SYSTEMS

[75] Inventor: Dominic A. Cusano, Schenectady, N.Y.

[73] Assignee: General Electric Company, Schenectady, N.Y.

[21] Appl. No.: 184,642

[22] Filed: Mar. 30, 1962

[51] Int. Cl.[3] ..... H01J 29/50; H01J 31/00

[52] U.S. Cl. ..... 315/13 ST; 313/463

[58] Field of Search ..... 250/80, 83, 213 VT, 250/484; 340/173; 313/65, 108, 92, 463; 315/10, 11, 12, 12 R, 13 ST

[56] References Cited

U.S. PATENT DOCUMENTS

| | | |
|---|---|---|
| 2,402,758 | 6/1946 | Leverenz . |
| 2,909,703 | 10/1959 | Williams . |
| 2,927,234 | 3/1960 | Kazan . |
| 2,939,029 | 5/1960 | Wahlig . |
| 2,992,349 | 7/1961 | Cusano . |
| 3,054,961 | 9/1962 | Smith . |
| 3,093,735 | 7/1963 | Blakewood . |

*Primary Examiner*—Theodore M. Blum

*Attorney, Agent, or Firm*—Marvin Snyder; James C. Davis, Jr.

EXEMPLARY CLAIM

1. A solid state storage device comprising: a luminescent screen including a continuous, crystalline, homogeneous, nongranular layer of a material consisting of one of a photoelectroluminescent phosphor and a cathodoelectroluminescent phosphor; means including a pair of electrically conducting layers in contact with opposite surfaces of said phosphor layer for establishing a unidirectional, transverse electric field therein; means directing information-containing energy upon one surface of said phosphor layer, said energy in combination with the transverse electric field being effective to produce an intensified visible light image from said screen and to form within the phosphor layer thereof a volume positive space charge latent image; and means for flooding said phosphor layer with energy less effective to produce a visible light image than said information-containing energy to cause the latent image previously formed within the phosphor layer to be displayed as a visible light image.

16 Claims, 5 Drawing Figures

SOLID STATE STORAGE DEVICES AND SYSTEMS

This invention relates to solid state storage devices and systems and more particularly to such devices and systems utilizing a screen comprising a solid luminescent material.

A great many electrical and electronic applications require some kind of information storage. For example, such information storage is required in electronic computers and many communication and switching systems and devices. Further, there is a continuing need to provide high speed information storage systems which are less complex. For example, various information storage systems are known in the prior art which provide for high speed access to stored information utilizing light or electron beams or related electrical means. Such prior art devices, however, are extremely complex and expensive and for many applications lack the desired resolution and storage density.

It is an object of this invention, therefore, to provide high speed storage systems and devices which are less complex than prior art systems and have improved resolution and storage density characteristics.

It is another object of this invention to provide inexpensive and simplified solid state storage systems and devices which provide high speed visual access to the information stored therein by means of light or electron beams.

It is still another object of this invention to provide light or electron beam sensitive and responsive solid state storage devices and systems utilizing a screen comprising a solid luminescent material.

It is yet another object of this invention to make possible cathode ray tubes, of the type employed in radar and oscilloscope equipment, exhibiting sustained image display which are simpler, less expensive and provide higher resolution than prior art devices of this type.

It is a further object of this invention to make possible storage or integrating features for high quality output screens of image converter tubes for such applications as sustained viewing, continuous photographic film exposure and the like.

It is a still further object of this invention to provide inexpensive high density information storage devices and systems for electronic computer applications wherein optical storage, "read-out" or display is utilized.

Briefly stated, in accordance with one aspect of this invention an improved and simplified solid state storage device comprises a luminescent screen comprising a continuous, crystalline, homogeneous, nongranular layer of a material selected from the group consisting of cathodoelectroluminescent and photoelectroluminescent phosphors, together with means, including a pair of continuous electrodes in direct contact with opposite surfaces thereof, for establishing a unidirectional, transverse electric field therein. Information to be stored is applied to the luminescent screen in the form of incident visible image producing energy, either radiant or cathode ray, and the stored information read out by flooding the screen with less effective visible image producing energy. The information may be read out, for example, by energy such as shorter wave length radiation or lower intensity cathode rays or other low volume penetrating, and preferably more absorbing energy. The information, therefore, is stored or read out by the concurrent application of the unidirectional transverse electric field and the relatively more and less visible image producing energy respectively.

The storage device may be cleared, or the stored information "erased," by removing the previously applied energy and the transverse electric field and flooding the screen with infrared radiation.

The novel features believed characteristic of the invention are set forth with particularity in the appended claims. The invention itself, however, both as to its organization and method of operation, together with further objects and advantages thereof, may best be understood by reference to the following description taken in connection with the accompanying drawing wherein similar elements are designated by the same reference numerals and in which:

Figure 1:
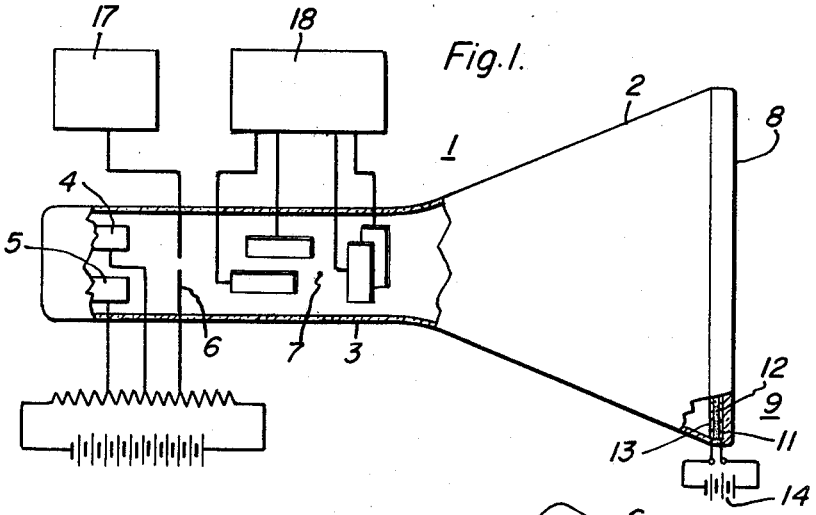
FIG. 1 shows a cathode ray tube illustrative of one type of apparatus embodying the principles of this invention.

It is known that luminescent solids may be excited to luminescence by incident cathode rays and by incident radiant energy such as x-rays, ultra violet and visible light. It has also been found that "light amplification" can be achieved by concurrently subjecting an appropriate photoelectroluminescent or cathodoelectroluminescent phosphor layer to suitable exciting energy and a transversely applied unidirectional electric field. For example, in my U.S. Pat. No. 2,909,692, there is described and claimed a Field Enhanced Luminescence System utilizing a luminescent screen comprising a photoelectroluminescent phosphor layer excited by incident radiant energy. Similarly, in my U.S. Pat., No. 2,992,349, there is described and claimed such a system utilizing a luminescent screen comprising a cathodoelectroluminescent phosphor layer excited by incident cathode rays.

I have discovered that a continuous, crystalline, homogeneous, nongranular layer of material, selected from the group consisting of photoelectroluminescent and cathodoelectroluminescent phosphors, when subjected concurrently to appropriate exciting energy therefor and a transversely applied unidirectional electric field forms therein a volume positive space charge latent image in addition to the amplified visible light image emitted therefrom. I have further discovered that this latent image may be displayed as a visible light image after cessation of the initial exciting energy by flooding the phosphor layer with less volume penetrating energy while concurrently applying the transverse, unidirectional electric field. Such display may be produced either continuously or periodically with significant storage times being exhibited. For example, the latent image formed within the phosphor layer may be displayed as a visible light image in accordance with this invention hours or even days after the intial exciting energy has been removed.

In one illustrative embodiment of this invention the latent image may be formed within a continuous, crystalline, homogeneous, nongranular cathodoelectroluminescent phosphor layer by concurrently applying thereto a transverse, unidirectional electric field and highly penetrating information containing cathode rays. The latent image so formed may be displayed hours or even days thereafter as a visible light image by flooding the phosphor layer with cathode rays of lower voltage, lower intensity, or of both lower voltage and lower intensity, and concurrently establishing a transverse, unidirectional electric field therein. Alternatively, the latent image may be similarly displayed as a visible light image by flooding the phosphor layer with radiant energy, such as ultra violet light or the like, which is more absorbing and less volume penetrating than the initial exciting cathode ray energy, and concurrently establishing the transverse, unidirectional electric field.

In yet another alternative the volume positive space charge latent image may be formed within the phosphor layer by incident radiant energy, such as highly penetrating ultra violet light of about 3650 Å for example, and concurrently established transverse electric field. The latent image so formed may be thereafter displayed as a visible light image by flooding the phosphor layer with lower penetrating energy, such as ultra violet light of shorter wavelength, of about 3100 Å for example, or by lower voltage, and/or lower intensity cathode rays.

Similar storage effects, with the formation of the volume positive space charge latent image and "read-out" thereof as a visible light image, may be produced utilizing a luminescent screen comprising a continuous, crystalline, homogeneous, nongranular photoelectroluminescent phosphor layer. Although for optimum results the latent image is preferably formed in a photoelectroluminescent phosphor layer by incident radiant energy and in a cathodoelectroluminescent phosphor layer by incident cathode rays, either combination of "read-in" and "read-out" means described above may be satisfactorily utilized.

Photoelectroluminescent phosphors may be briefly characterized as those phosphors which are capable of exhibiting light emission which is of greater intensity and contains greater energy than the controlling radiation when the phosphor is subjected to the concurrent stimulation of incident radiation and a transversely impressed unidirectional electric field, applied by electrodes in direct contact with opposite surfaces of a layer of such phosphor so that charge transport may occur therethrough.

Similarly, cathodoelectroluminescent phosphors may be briefly characterized as those phosphors which are capable of exhibiting light emission which is of an intensity greater than that obtainable utilizing cathode ray excitation alone and which may contain greater energy than the controlling cathode rays when the phosphor layer is subjected to the concurrent stimulation of incident cathode rays and a transverse, uniform, unidirectional electric field, applied by electrodes in direct contact with opposite surfaces of a layer of such phosphor material so that charge transport may occur therethrough.

Since the solid state storage devices and systems of this invention employ a luminescent screen comprising photoelectroluminescent or cathodoelectroluminescent phosphors, the characteristics of these materials will be described with respect to the phenomena of photoelectroluminescence and cathodoelectroluminescence and the characteristics necessary for their existence.

Both photoelectroluminescence and cathodoelectroluminescence are processes which depend for their operation upon the principle of mobile charge increase and field intensification within a phosphor layer. When a layer of photoelectroluminescent or cathodoelectroluminescent phosphor is in contact with a pair of electrodes, one of which is metallic, disposed on opposite surfaces thereof and a voltage is applied, a uniform transverse electric field is established within the phosphor layer. When incident radiation or cathode rays fall upon a photoelectroluminescent or cathodoelectroluminescent phosphor layer, the electric field already existing in the vicinity of the cathode, or negatively maintained electrode, is increased. This increased electric field in the vicinity of the negatively maintained electrode is due to the formation there of a positive space charge caused by the release of electrons originally bound to the crystal lattice, locally at impurity or instrinsic defect sites. These electrons are released due to the incident penetrating cathode ray or radiant energy raspectively. This increased electric field in the vicinity of the negatively maintained electrode results in the injection of a large number of free electrons from the metallic electrode into the region of the phosphor layer adjacent the negatively maintained electrode. These injected electrons are accelerated by the high electric field there to excite activator centers within this portion of the phosphor layer, causing the release of a much greater number of photons of radiant energy than are released by either incident cathode ray or radiant energy excitation alone. In both cathodoelectroluminescence and photoelectroluminescence, therefore, there is an actual charge transport, or current flow, through the phosphor layer. Moreover, the number of electrons passing from cathode to anode per initial freed electron may be in the range of about $10^2$ to $10^6$. This current may also increase with increasing distance from the negatively maintained electrode by inelastic collisions which create electron avalanches.

I have discovered that, when the exciting energy, such as cathode ray or radiant energy, is removed, the space charge formed thereby within the phosphor layer in the vicinity of the negative electrode by the release of electrons originally bound to the crystal lattice at imperfection sites remains for an enduring period. Further, since the space charge within the phosphor layer was formed by the information containing volume penetrating exciting energy, it comprises a latent image corresponding to this information.

In further accord with this invention, this latent image is displayed as a visible light image by flooding the phosphor layer with less effective visible light image producing energy, as for example less volume penetrating, and preferably more highly absorbing, energy and concurrently applying a unidirectional potential transversely thereacross. This less volume penetrating or otherwise less effective energy is ordinarily insufficient to produce anywhere near as high a space charge within the phosphor layer as the initial exciting energy but is operative, in combination with the unidirectional transverse electric field, to again allow for the injection of a large number of free electrons from the metallic electrode into the region of the phosphor layer adjacent the negative electrode. These electrons are then accelerated by the electric field to excite activator centers within this high field portion of the phosphor layer to release a great number of photons of radiant energy, thereby displaying the space charge latent image as a visible light image.

For simplicity, this may also be considered as a "redisplay" of the original image at a time after cessation thereof. For example, at some time after removal of the information containing energy there is essentially no luminescence from the phosphor layer. When the phosphor layer is then flooded with a less effective visible light producing energy such as lower voltage, lower intensity cathode rays or shorter wave length radiation, this information is caused to reappear as a visible light image which appears substantially the same as when the information containing energy was being applied. Alternatively, the phosphor layer may be flooded with cathode rays of substantially the same intensity but of lower current density and again the latent image is caused to be redisplayed as a visible light image.

With a periodic rather than a continuous display, storage times of hours and days may be achieved with satisfactory luminescent intensity for visual observation. For example, one particular device utilizing a cathodoelectroluminescent phosphor layer, having a unidirectional, transverse electric field established therein by an applied potential of about 40 volts, was subjected to information containing incident cathode rays of about 27 kilovolts for a fraction of a second and then removed. The screen was then flooded with less effective visible light producing energy in the form of 8 kilovolt cathode rays and the image continuously "read" for about 15 minutes. During this period the original image resolution of about 50 lines per millimeter was preserved, the brightness remained above about one foot Lambert and only a gradual deterioration in contrast was observed. Removing both the 8 kilovolt cathode ray flooding beam and the 40 volt transverse electric field and subjecting the screen to infrared radiation resulted in the complete removal or "erasure" of the volume space charge latent image within the phosphor layer thereby "clearing" the solid state storage device.

The length of time required for the volume positive space charge, formed within the phosphor layer, to disappear or "leak away" can be made relatively long depending upon a variety of factors such as the composition of the phosphor, the combination of activators and coactivators, the degree of crystallinity, the lifetime of the ionized activator or photosensitive center, the nature and position of the acceptor level, its electron capture cross section, as well as other factors which, presently, are not fully understood.

The phenomenon of the volume space charge latent image within the phosphor layer may be observed in both cathodoelectroluminescent and photoelectroluminescent phosphors. Cathodoelectroluminescence and photoelectroluminescence have been observed with members of the zinc-cadmium sulfo-selenide family including zinc sulfide, cadmium sulfide, zinc selenide, cadmium selenide or mixtures thereof such as zinc-cadmium sulfide, zinc-cadmium selenide, cadmium-sulfo-selenide, zinc-cadmium-sulfo-selenide and zinc-sulfo-selenide, activated with manganese, arsenic, phosphorous or antimony and a halogen, or one of the foregoing phosphor materials activated with two or more of the above activators and a halogen. For longer storage times, the phosphor material is preferably activated with manganese and a halogen, such as chlorine, with a secondary activator of arsenic, antimony or phosphorus.

For clarity and simplicity the principles of this invention will be described in detail with respect to a cathode ray tube-type storage device. The cathode ray tube storage device shown in FIG. 1, therefore, is intended as an illustrative embodiment of this invention. It will be understood, however, that this invention has a wide range of applications and may be embodied in many different types of devices and apparatus such as image converter storage devices, sustained image display cathode ray tubes, information storage devices for electronic computer applications and the like.

As shown, the cathode ray tube, designated generally at 1, includes an evacuable envelope having a conical section 2 and a neck portion 3. Two electron guns 4 and 5, a modulating or control electrode 6, and a set of deflection plates 7 are disposed within the neck portion 3. Cathode rays from either of electron guns 4 and 5 impinge upon face plate 8 upon which there is located a luminescent screen 9. Electron guns 4 and 5 may both be located in the neck portion of tube 1 as illustrated or one of the guns may be disposed elsewhere within the tube envelope and adapted to flood the entire luminescent screen 9 with cathode rays. Alternatively, a single electron gun may be utilized which is adapted to provide both the information containing cathode ray or "writing" beam and the flooding cathode ray or "read" beam respectively.

Figure 2:
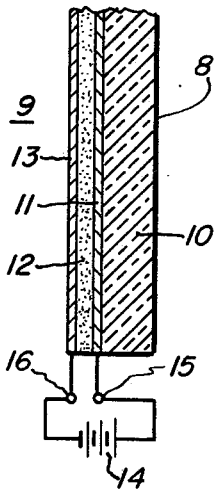
FIG. 2 shows a vertical cross-sectional view of a portion of the luminescent screen utilized in the device of FIG. 1, FIGS. 3 and 4 show cathode ray tubes illustrative of other embodiments of this invention.

Luminescent screen 9, an enlarged vertical cross-sentional portion of which is shown in FIG. 2, comprises a visible light transmissive base plate 10 which may be for example, glass, mica, quartz, or any other suitable visible-light transmissive material upon which the other elements of the screen may be formed. A first visible-light transmissive electrically conducting film 11 is in direct contact with base plate 10. A cathodoelectroluminescent or photoelectroluminescent phosphor layer 12 is in direct contact with conducting film 11. Finally, a thin metallic conducting layer 13 is in direct contact with phosphor layer 12. A unidirectional electric field is established transversely within phosphor layer 12 by a source of unidirectional potential, shown schematically as battery 14, which applies a unidirectional voltage to conducting layers 11 and 13 by means of terminals 15 and 16.

Electrode 11 may conveniently comprise any visible-light transmissive, conducting material, such as tin oxide, but is preferably a thin layer of reduced titanium dioxide. As deposited, titanium dioxide is not highly conducting but may be rendered conducting by the subsequent deposition thereon of a layer of cathodoelectroluminescent or photoelectroluminescent phosphor, or by the method disclosed and claimed in U.S. Pat. No. 2,717,844, to L. R. Koller.

As described hereinbefore cathodoelectroluminescence and photoelectroluminescence, with the formation of a volume positive space charge latent image, requires current flow through the phosphor layer. To this end there must first be direct electrical contact between phosphor layer 12 and electrode layers 11 and 13 which must be electrically continuous to provide a uniform field.

Further, since cathodoelectroluminescence and photoelectroluminescence depend upon charge injection from electrodes and charge transport through the phosphor, there must be a continuity of electrical properties throughout the layer. To this end phosphor layer 12 must be composed entirely of the particular luminescent phosphor material selected and which is homogeneous, continuous, crystalline, nongranular and exhibits essentially uniform electrical properties throughout. Such a phosphor layer is to be distinguished, for example, from the conventional luminescent phosphor layers in which microcrystals of luminescent materials are suspended in powder dielectrics or are settled out into a heterogeneous mass by conventional liquid settling or equivalent techniques. If the electrical properties throughout the phosphor layer are not essentially uniform there may be no charge transport and cathodoelectroluminescence or photoelectroluminescence may not occur. Since the formation of the volume positive space charge latent image has been observed only with those phosphors which exhibit cathodoelectroluminescence or photoelectroluminescence, only luminescent phosphor layers which are composed entirely of the selected phosphor material and which are homogeneous, continuous, crystalline, nongranular and exhibit uniform electrical properties are suitable for use in the practice of this invention.

The formation of suitable cathodoelectroluminescent and photoelectroluminescent layers may be in accordance with the method disclosed and claimed in U.S. Pat. No. 2,685,530, to Cusano and Studer. In accordance with that method the desired phosphor layer is prepared by chemically reacting the vapors containing phosphor constituents and the selected activators and co-activators in the vicinity of a substrate upon which the layer is formed to cause the crystallization from the vapor phase of a continuous, crystalline, homogeneous, nongranular layer composed entirely of the activated phosphor material. A suitable phosphor layer may also be formed, however, by any method of phosphor preparation which results in the formation of a suitably activated, continuous, crystalline, homogeneous, nongranular phosphor layer upon a selected substrate. For example, the phosphor layer may be formed in accordance with vacuum evaporation techniques which produce a deposited layer meeting the foregoing criteria.

Referring again to FIG. 1, a beam of electrons, generated for example by electron gun 4, is modulated, so as to contain information or intelligence, by control electrode 6 to which an appropriate signal energy is supplied, as by video output circuit 17. The electron beam so modulated is swept in a raster pattern by deflection plates 7 which are supplied a sweep signal by sweep generator 18 in well-known manner. A raster pattern of information-containing cathode rays is thus impressed upon phosphor layer 12 through the thin, metallic, electron permeable, electrode layer 13.

The concurrent stimulation of the cathode ray beam and transverse electric field causes a cathodoelectroluminescent visible image to be produced by phosphor layer 12 which may be viewed through light transmissive electrode layer 11 and face plate 8. At the same time, a volume positive space charge is formed within the phosphor layer as described hereinbefore which remains for an enduring period after removal of stimulation. For example, the volume positive space charge remains for an enduring period after either the cathode ray beam alone or both the cathode ray beam and the electric field have been removed. Ordinarily, longer storage times may be expected if the transverse electric field is maintained across the phosphor layer and only the exciting energy is removed. This volume positive space charge constitutes a latent image corresponding to the information contained in the exciting cathode ray beam.

The latent image may be subsequently produced as a visible image, which may again be viewed through light transmissive electrode 11 and face plate 8, by flooding the phosphor layer 12 with energy which is less effective in producing visible light therefrom while simultaneously applying the transverse electric field thereto. To this end a less volume penetrating energy such as a low intensity beam of electrons, generated by electron gun 5, is swept in a raster pattern by deflection plates 7 thereby impressing a raster pattern of cathode rays on phosphor layer 12. Preferably, the electron beam from electron gun 5 is unmodulated by control electrode 6 so that phosphor layer 12 has impressed thereon a raster pattern of essentially uniform intensity. Moreover, it will be understood that this less volume penetrating "reading" beam need not be impressed on phosphor layer 12 in a raster pattern since in this respect it is only necessary that the entire layer be subjected to such energy. Conveniently, therefore, the "reading" energy may simply flood phosphor layer 12.

The concurrent stimulation of the "reading" electron beam from electron gun 5, even if modulated so as to contain information, and the transverse electric field is operative, in combination with the previously formed volume positive space charge, to allow for the injection of a large number of free electrons from metallic electrode 13 which are then accelerated by the electric field to excite activator centers within the positive space charge region of the phosphor layer causing the release of a large number of photons of radiant energy to produce a visible image corresponding to the volume positive space charge latent image previously formed therein.

The "reading" energy, either cathode ray or radiant, in combination with the applied field, may be capable of producing a visible image. The "reading" energy, however, has been chosen to be relatively less effective in this respect than the initial or "writing" energy. For example, the "reading" energy may be less volume penetrating, more highly absorbing, have less current density if an electron beam, or posses other characteristics which make it relatively less effective in providing a visible light image from the luminescent screen. As a result, the predominant visible image displayed on the screen is that due to the previously formed latent image. The "reading" energy, therefore, is operative to cause the original image to be "redisplayed" as a visible light image.

To achieve intensified images, and initially form a volume positive space charge latent image within phosphor layer 12, the average field strength established therein should be approximately $10^4$ to $10^5$ volts per centimeter. In accordance with the embodiment shown in FIG. 1, battery 14 is connected with the positive terminal to transparent electrode layer 11 and the negative terminal to metallic, electron permeable, electrode layer 13. For 5 to 30 kilovolt information containing electron beams, wherein the phosphor may conveniently be about 10 microns thick, for producing the initial visible image and forming the space charge latent image, battery 14 may supply about 25 to 100 volts. For higher energy beams the phosphor layer may be thicker and battery 14 may supply a higher voltage.

The latent image may be displayed as a visible image utilizing the same voltage across the phosphor layer but with incident exciting energy which is relatively less effective in producing a visible image than the initial information containing energy. For example, although initially a visible, intensified image may be produced with the applied field and an electron beam of about 5 10 kilovolts, relatively less effective visible image producing energy, such as for example this same voltage beam of lower current density does not produce a new visible image but instead causes a redisplay of the original image. When the screen is cleared, however, such as by removing the concurrent stimulating energy and flooding with infrared radiation, this less effective visible image producing electron beam may be sufficient, with the applied electric field, to produce an observable image on the screen.

In this respect, therefore, the incident information containing energy employed for "writing," or storing information in the phosphor layer, must be relatively more effective in producing the space charge and the visible image than the incident energy employed for gaining access to such stored information. For example, if an intensified visible image is produced with a cathode ray beam of one voltage and current density to provide a certain volume penetration then the voltage and/or current density of the read-out cathode ray beam should be such that a lower volume penetration is achieved. The fact that such a readout cathode ray beam could itself initially be capable of storing information does not make it too effective to be employed for reading out the stored information as a visible image so long as it is relatively less effective than the incident information containing beam which produced the original image and formed the space charge latent image within the phosphor layer.

Figure 3:
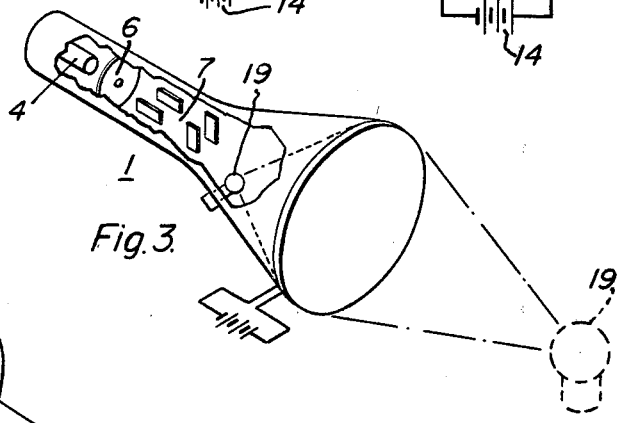

In FIG. 3 there is shown another illustrative embodiment of this invention. As shown the cathode ray tube 1 is similar to that shown in FIG. 1 except that only one electron gun need be provided. The single electron gun 4 is employed to produce the information containing cathode ray beam for producing the original visible image and the volume space charge latent image. The latent image is subsequently displayed by flooding the screen with incident radiant energy from radiant energy source 19. Source 19 may project x-rays, ultraviolet, blue or visible light and is so selected that the radiation therefrom is less volume penetrating, less intense, or otherwise less effective than the cathode rays utilized in tube 1 for producing the original visible image and the volume positive space charge latent image.

Conveniently, source 19 may be disposed, as shown diagrammatically in FIG. 3, so that the radiation therefrom impinges upon the same side of the phosphor layer as does the more effective cathode ray beam. Since such radiation must directly irradiate the phosphor layer, it will be understood that for such a location electrically conducting layer 13 should be at least semi-transparent to the radiation of source 19. Alternatively, source 19 may be disposed, as shown in phantom, so that the radiation therefrom impinges upon the phosphor layer through face plate 8 and transparent electrically conducting layer 11.

Figure 4:
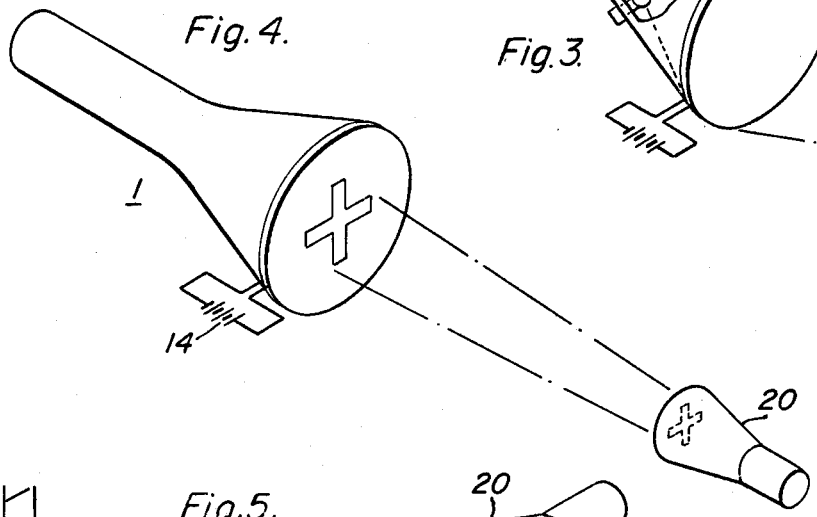

FIG. 4 shows still another embodiment of this invention employing a cathode ray tube such as that in FIG. 2 with a single source of cathode rays. In this embodiment, however, a source of information containing radiant energy 20, which again may project x-rays, ultraviolet, blue or visible light emits information containing radiation which falls upon phosphor layer 12 exciting it to luminescence causing a visible light image to be emitted therefrom and also forming the volume space charge latent image therein. Although as shown the source 20 projects the information containing radiant energy, it will be understood that source 20 could be replaced by a source such as 19 which projects unmodulated radiation which is modulated by an intermediate object, such as a photographic negative or the like, before impinging upon phosphor layer 12. Electron gun 4 of tube 1 is then employed to generate an electron beam whose characteristics are such that a less volume penetrating beam of cathode rays impinges upon phosphor layer 12 to cause the latent image, stored therein by the more penetrating information containing radiation, to be displayed as a visible light image.

Figure 5:
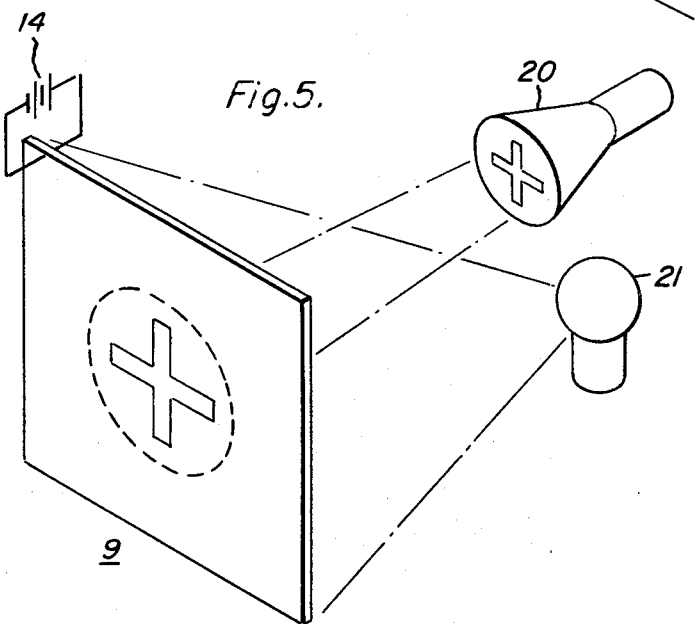
FIG. 5 shows still another illustrative embodiment of this invention.

FIG. 5 shows yet another illustrative embodiment of this invention wherein information may be both stored and retrieved by means of radiant energy. As shown, a source of information containing radiant energy 20 emits information containing radiation which falls upon a luminescent screen 9 such as shown in detail in FIG. 2. The information containing radiation from source 20 in combination with the applied unidirectional, transverse electric field excites the screen to luminescence causing a visible light image to be emitted therefrom and forming within phosphor layer 12 thereof a volume positive space charge latent image.

A second source of radiant energy 21 is provided which is selected to project radiation which is less volume penetrating or otherwise less effective in producing a visible image than that of source 20. For example, source 21 may project radiation of shorter wavelength than that of source 20 so that if source 20 projects information containing ultraviolet light of about 3650 Å to store the information in the form of the space charge latent image, source 21 may project ultraviolet light of about 3100 Å to display this latent image as a visible light image.

There has been described hereinbefore solid state storage devices and systems utilizing a screen comprising a solid luminescent material. Such devices are capable of improved resolution and storage density. This invention, therefore, is capable of providing new and improved solid state storage systems, image converter storage tubes, cathode ray tubes as well as a wide range of other devices.

While this invention has been described in detail herein with reference to certain illustrative embodiments, many changes and modifications as well as other applications will occur to those skilled in the art. It is, therefore, to be understood that the appended claims are intended to cover all such changes and modifications as fall within the true spirit and scope of the invention.

What I claim as new and desire to secure by Letters Patent of the United States is:

1. A solid state storage device comprising: a luminescent screen including a continuous, crystalline, homogeneous, nongranular layer of a material consisting of one of a photoelectroluminescent phosphor and a cathodoelectroluminescent phosphor; means including a pair of electrically conducting layers in contact with opposite surfaces of said phosphor layer for establishing a unidirectional, transverse electric field therein; means directing information-containing energy upon one surface of said phosphor layer, said energy in combination with the transverse electric field being effective to produce an intensified visible light image from said screen and to form within the phosphor layer thereof a volume positive space charge latent image; and means for flooding said phosphor layer with energy less effective to produce a visible light image than said information-containing energy to cause the latent image previously formed within the phosphor layer to be displayed as a visible light image.

2. The solid state storage device of claim 1 wherein the information-containing energy is an electron beam.

3. The solid state storage device of claim 1 wherein the information-containing energy is a radiant-energy beam.

4. The solid state storage device of claim 1 wherein the information-containing energy effective to produce an intensified visible light image and form the volume positive space charge latent image within the phosphor layer is highly volume penetrating energy and the energy flooding the phosphor layer to produce therefrom the display of the latent image as a visible light image is less highly volume penetrating energy.

5. The solid state storage device of claim 4 wherein the information-containing energy is highly volume penetrating radiation and the energy flooding the phosphor layer to produce therefrom the display of the latent image as a visible light image is less highly volume penetrating radiation.

6. The solid state storage device of claim 5 wherein the information-containing radiant energy is ultraviolet radiation of one wavelength and the radiant energy flooding the phosphor layer to produce therefrom a visible light display of the latent image previously formed therein is ultraviolet radiation of shorter wavelength.

7. The solid state storage device of claim 6 wherein the information-containing ultraviolet radiation has a wavelength of about 3650 Å and the ultraviolet radiation flooding the phosphor layer to produce therefrom a visible light display of the latent image previously formed therein has a wavelength of about 3100 Å.

8. A solid state storage device comprising: a luminescent screen including a continuous, crystalline, homogeneous, nongranular layer of a material consisting of one of a photoelectroluminescent phosphor and a cathodoelectroluminescent phosphor; and a pair of electrically conducting layers in direct contact with opposite surfaces thereof, one of said electrically conducting layers being metallic and at least one being visible light transmissive; means associated with said electrically conducting layers for establishing a unidirectional transverse electric field within said phosphor layer; means directing information-containing energy through one of said electrically conducting layers and upon said phosphor layer, said energy in combination with said electric field being effective to produce an intensified visible light image on said luminescent screen and form a volume positive space charge latent image within the phosphor layer thereof; and means for flooding said phosphor layer with energy less effective to produce a visible light image from said luminescent screen than said information-containing energy to cause the latent image previously formed within said phosphor layer to be displayed as a visible light image.

9. The solid state storage device of claim 8 wherein at least one of said electrically conducting layers is electron-permeable and the information-containing energy effective to produce the intensified visible light image and form the latent image within the phosphor layer is an electron beam.

10. The solid state storage device of claim 9 wherein the energy flooding said phosphor layer and less effective to produce a visible light image therefrom than said information-containing electron beam is also an electron beam.

11. A solid state storage device comprising: a luminescent screen including a continuous, crystalline homogeneous, nongranular, photoelectroluminescent phosphor layer adapted to be directly excited to luminescence by information-containing radiant energy impinging thereon; a thin electrically conducting film which is transparent to incident radiation to which said layer is responsive contacting one surface of said phosphor layer; a thin electrically conducting film which is transparent to light emitted by said phosphor layer when excited contacting the opposite surface thereof; means applying a unidirectional voltage between said electrically conducting films for establishing a unidirectional, transverse, electric field within said phosphor layer; means directing information-containing radiant energy upon one side of said phosphor layer which radiation is effective to directly excite said phosphor layer and produce an intensified image therefrom and form therein a volume positive space charge latent image; and means for flooding said phosphor layer with radiant energy which is less effective to produce an image but operative to cause said latent image to be displayed as a visible image.

12. The solid state storage device of claim 11 wherein said information-containing radiant energy is ultraviolet radiation of one wavelength and the radiant energy flooding said phosphor layer to display said latent image is ultraviolet radiation of shorter wavelength.

13. A cathode ray storage device comprising: an evacuable envelope having at one end thereof a luminescent screen, said screen including only a phosphor layer consisting entirely of a material consisting of one of a photoelectroluminescent phosphor and a cathodoelectroluminescent phosphor which is continuous, crystalline, homogeneous, nongranular and a pair of electrically conducting layers contacting opposite surfaces of the phosphor layer, at least one of said electrically conducting layers being electron permeable; means associated with said electrically conducting layers for establishing a unidirectional transverse electric field within said phosphor layer; means at another end of said envelope for generating, modulating, focusing and deflecting a beam of cathode rays over said screen to directly irradiate and excite said phosphor layer, said beam in combination with said electric field being effective to initiate emission from said phosphor layer and form a volume positive space charge latent image therein; and means for flooding said phosphor layer with energy which is less effective to initiate emission therefrom but which is operative to cause said latent image previously formed within said phosphor layer to be displayed on said luminescent screen.

14. The cathode ray storage device of claim 13 wherein the means flooding said phosphor layer with less effective energy operative to cause a display of the latent image is a means within said evacuable envelope for generating a beam of cathode rays.

15. The cathode ray storage device of claim 13 wherein the means flooding said phosphor layer with less effective energy operative to cause a display of the latent image previously formed therein is a source of radiant energy.

16. A cathode ray storage device comprising: an evacuable envelope having at one end thereof a luminescent screen, said screen including a phosphor layer consisting of one of a photoelectroluminescent phosphor and a cathodoelectroluminescent phosphor which is continuous, crystalline, honogeneous and nongranular, and a pair of electrically conducting layers contacting opposite surfaces of the phosphor layer, at least one of said electrically conducting layers being electron permeable; means associated with said electrically conducting layers for establishing a unidirectional transverse electric field within said phosphor layer; means for directing information-containing radiant energy through one of said electrically conducting layers to directly irradiate and in combination with said electric field excite said phosphor layer to initiate emission therefrom and form a volume positive space charge latent image therein; means at another end of said envelope for generating and focusing a beam of cathode rays on said phosphor layer, said beam of cathode rays being less effective than said radiant energy to initiate emission from said phosphor layer but operative to cause said latent image previously formed therein to be displayed on said luminescent screen.

* * * * *